United States Patent [19]

Sack

[11] 4,133,688

[45] Jan. 9, 1979

[54] PHOTOGRAPHIC CARRIER MATERIAL CONTAINING THERMOPLASTIC MICROSPHERES

[75] Inventor: Wieland H. Sack, Bissendorf, Fed. Rep. of Germany

[73] Assignee: Felix Schoeller, Jr., Fed. Rep. of Germany

[21] Appl. No.: 813,878

[22] Filed: Jul. 8, 1977

Related U.S. Application Data

[63] Continuation-in-part of Ser. No. 651,602, Jan. 22, 1976, abandoned.

[30] Foreign Application Priority Data

Jan. 24, 1975 [GB] United Kingdom ..... 03261/75

[51] Int. Cl.[2] ..... D21H 1/28; D21H 3/00; G03C 1/87

[52] U.S. Cl. ..... 96/87 R; 162/101; 162/158; 162/164 R; 162/168 R; 162/168 N; 162/181 A; 162/181 B; 162/184; 264/51; 264/53; 264/54; 264/DIG. 6; 428/306; 428/314; 428/327; 428/514; 428/539; 428/913

[58] Field of Search ..... 162/50, 101, 158, 164 R, 162/168 R, 168 N, 168 NA, 169, 173, 181 A, 181 B, 183, 184, 185, 186, 192, 206, 207; 96/85, 87 R; 264/22, 25, 26, 41, 51, 53, 54, DIG. 6, DIG. 46; 204/157.1 R, 157.1 H, 160.1; 260/17.4 CL, 2.5 R, 2.5 B; 428/306, 307, 314, 323, 327, 403, 407, 411, 474, 512, 513, 539, 913

[56] References Cited

U.S. PATENT DOCUMENTS

| | | | |
|---|---|---|---|
| 2,838,397 | 6/1958 | Gruntfest et al. | 162/168 N |
| 3,242,238 | 3/1966 | Edberg et al. | 264/26 |
| 3,253,064 | 5/1966 | Buonaiuto | 264/26 |
| 3,293,114 | 12/1966 | Kenaga et al. | 162/168 N X |
| 3,379,799 | 4/1968 | Goldman | 264/26 |
| 3,411,908 | 11/1968 | Crawford et al. | 96/85 X |
| 3,483,077 | 12/1969 | Aldrich | 162/158 |
| 3,662,043 | 5/1972 | Rubens | 264/53 X |

OTHER PUBLICATIONS

Kenaga, "Microsphere Paper," TAPPI Journal, 12-1973, vol. 56, No. 12, pp. 157-160.

Treier, "Development of a Unique Lightweight Paper", TAPPI Journal, vol. 55, No. 5, 5-1972, pp. 769-771.

*Primary Examiner*—Arthur L. Corbin

*Attorney, Agent, or Firm*—Allegretti, Newitt, Witcoff & McAndrews

[57] ABSTRACT

A photographic carrier material comprising a cellulose sheet which is coated on both surfaces with a polyolefin resin and in which hollow, thermoplastic microspheres are uniformly mixed therein in an amount of from 0.5 - 5.0 weight percent.

14 Claims, No Drawings

PHOTOGRAPHIC CARRIER MATERIAL CONTAINING THERMOPLASTIC MICROSPHERES

RELATED APPLICATION

This application is a continuation-in-part of my copending application, Ser. No. 651,602, filed Jan. 22, 1976, now abandoned.

THE INVENTION

The present invention relates to a carrier material for layers containing silver salts sensitive to light which material includes a paper core coated with a polyolefin coating on both sides and, in particular, to a polyolefin coated photographic paper carrier.

Photographic paper carriers for color or black and white photographic layers having silver salts sensitive to light, are known which comprise cellulose papers or cellulose papers covered with a layer containing barium sulfate. Such papers, due to their porosity and the hydrophilic character of the cellulose, absorb a substantial amount of the photographic treatment fluids during developing and fixing of the photographic pictures. Such fluids must be removed in time consuming washing processes, otherwise they will cause a brown discoloration of the paper during the storage of the photographs.

These disadvantages of the prior photographic papers led to the introduction of waterproof, resin coated papers as carriers for the photographic layers. In particular, papers which are coated on both sides with a thermoplastic polyolefin have found extensive use as carriers for photographic layers, because such polyolefin coatings seal the paper. The polyolefin layers are customarily applied to the paper surfaces by extrusion coating using broad slot jets whereby the base paper must be treated in a special manner first to insure adequate adhesion of the polyolefin. A thorough description of such paper carriers coated with polyolefins for photographic layers, is found in U.S. Pat. No. 3,411,908.

Because of the peculiarities of the photographic layers to be applied to the polyolefin coatings, special requirements with respect to light reflection, whiteness, smoothness and sensitivity must be met by the resin coated carrier material and, particularly, by the polyolefin resin layer which is to carry the light sensitive layers. For this reason, this artificial polyolefin resin layer usually contains additives, such as inorganic white pigments, such as titanium dioxide of the rutile type (compare U.S. Pat. No. 3,833,380), dyes and optical brighteners (compare U.S. Pat. Nos. 3,501,298 and 3,676,175), or other substances (compare United Kingdom Spec. No. 1,286,907). Also mixtures of various polyolefins (compare United Kingdom Spec. No. 1,112,093) or mixtures of polyolefins with other resins (compare German DOS No. 2,310,887) have been employed to attain special effects.

It is important that the surface quality of the material makes it receptive to the layers sensitive to light (compare U.S. Pat. No. 3,647,619 and German DOS No. 2,250,063). Customarily, the base paper is processed by paper machine smoothing equipment or supercalenders, such that the paper surface is smoothed and compacted in order to prepare it as a foundation for a uniform coating of the polyolefin as described in Example 7, U.S. Pat. No. 3,411,908. A hitherto unavoidable disadvantage of this process is that the smoothing and compacting results in a loss of rigidity or stiffness of the material which can result in conveying difficulties when processing the coated material in modern developing processes. Another disadvantage of the photographic paper carrier which is coated on both sides with a polyolefin coating is that the cut edges are not protected against the penetration of the developing and fixing solutions. Even though the carrier material customarily spends only a very short time in modern automatic development devices in the developing fluids, these fluids can penetrate from a few to several tens of mm into the polyolefin coated paper at its unprotected edges. Also, because the washing periods after the development and fixing of photographic pictures in the automatic devices are customarily short, the developing and fixing solutions which have penetrated into the unprotected edges of the coated paper are not fully removed. After drying of the carrier, these penetrated fluids become discolored and dark and the discolored edges must be cut off.

It is therefore advantageous to reduce such penetration of the photographic developer fluids into the unprotected paper edges. Attempts to reduce or eliminate such penetration have included bonding of the paper core, but such bonding does not produce a completely satisfactory solution. Moreover, even though the already described polyolefin coating of the paper does have a sealing effect on the penetration of the photographic fluids through the surfaces of the paper, it unavoidably also results in the cited undesired reduction in rigidity or stiffness of the paper. Consequently, there still does not exist a carrier material which is free of the known disadvantageous edge penetration of photographic fluids into the unprotected edges of the polyolefin coated paper carrier. To the inventor's knowledge no paper carrier material exists which combines both the requisite surface smoothness and the desired stiffness or rigidity and, at the same time minimizes edge penetration.

Papers have been known in the past which have high specific volumes due to the addition of hollow microspheres into the paper sheet. As compared to papers of like thickness without microspheres, the microsphere papers have a significantly higher stiffness. The production of such microsphere papers is described for example in U.S. Pat. No. 3,293,114. Papers with microspheres, not only have high specific volumes and increased stiffness, but also exhibit an exceptional degree of porosity (Kenaga, D.L., Microsphere Paper, Tappi, Vol. 56, No. 12, Dec. 1973, p. 159). Consequently, such porous microsphere papers would not be expected to be suitable as photographic carriers, because the emulsions and solutions in the photographic layers which are sensitive to light would be expected to penetrate in an uncontrollable manner into the porous material and no coherent layer sensitive to light would be obtained. Moreover, such increased porosity would be expected to lead to increased edge penetration of the developing and fixing fluids.

Thus, according to the present state of the art, one skilled in the photographic carrier art would expect to realize reduced surface penetration by coating such papers, according to U.S. Pat. No. 3,411,908, on both sides with polyolefin resins. However, because increased porosity would usually mean increased liquid absorption, one skilled in the art would expect edge penetration to be aggravated in photographic carrier materials employing paper cores having microspheres therein. Such increased porosity - increased liquid absorption is borne out by the previously cited Kenaga publication that discloses that increased absorption occurs and that the paper sheet is opened up by the microspheres. Even after the requisite light calendering is carried out on the carrier material for the purpose of smoothing its surfaces, calendered material having microspheres would be expected to have a higher porosity than a comparable paper without microspheres. On the contrary, applicant has discovered that surprisingly, edge penetration of the developing and fixing fluids is substantially reduced in polyolefin coated papers having microspheres incorporated therein.

The aim of the present invention is, therefore, to produce a paper carrier for light-sensitive layers which is coated with polyolefin resin, but does not possess the disadvantages described. In particular, one of the principal purposes of the invention is to produce a carrier material with unchanged high surface quality and an enhanced stiffness, while at the same time reducing edge penetration. Such material, thereby, is suitable for utilization in automatic picture developing devices currently on the market.

The improved photographic carrier material for light-sensitive layers of the present invention contains, as a core, a paper having thermoplastic hollow microspheres therein which does not have the disadvantages previously discussed. More particularly, the carrier material of the present invention comprises a cellulose paper core which contains hollow microspheres of vinylidene chloride/acrylonitrile copolymers, and may also include synthetic resins which resist damping, a hydrophobic media, and in which both of the surfaces of the material, after a light calendering, are covered with polyolefinic synthetic resin layers.

Other materials may also be added to the paper core of the photographic carriers of the present invention, without adversely influencing the advantageous qualities of the material. A few possible additional materials are white pigments, mineral or organic filler materials, dyes and coloring materials, white toners, antistatic agents and antioxidants. Furthermore, for the improvement of the adhesion of the superimposed synthetic resin layers, an undercoat which improves adhesion can be applied, or a surface treatment of the paper core can be effected, before the polyolefin synthetic resins or synthetic resin mixtures are applied.

The polyolefin synthetic resin layers may contain, as components, polyethylene, polypropylene, ethylene-copolymers with lesser quantities of other olefinic monomers or mixtures of these polymers. Moreover, the polyolefin layers can also contain white pigments, dyes, white toners, ultraviolet absorbers, antioxidants, lubricants and/or other additives, as for example described in several of the patents previously cited. One or both surfaces can be not only made glossy, but may be structured in a different manner (compare U.S. Pat. No. 3,959,546). A surface of the resulting laminate is then prepared for the reception of one or several layers sensitive to light or other radiation. For this purpose, the surface may be treated in a known manner with a high-frequency corona and/or provided with another coat which furthers the adhesion of the photographic layers. The other, or back, surface of the laminate produced according to the invention can remain untreated or can also include further layers conditioned as, for example, described in U.S. Pat. Nos. 3,615,550 and 3,630,740.

The following are examples of photographic carrier materials made in accordance with the present invention and which are useful as carrier materials for either color or black and white photographic layers.

Carrier Material for Photographic Layers in Color or Black/White

EXAMPLE 1

A cellulose mixture of 70% conifer sulfate cellulose (softwood sulfate) and 30% hardwood sulfite, was pulped in the customary manner and then ground to 35° Schopper-Riegler. This cellulose suspension was then sized with 0.5 weight % (with reference to the cellulose) of a synthetic alkylketene dimer (for example "Aquapel 360XZ", Hercules Powder Company). One weight % (with reference to the cellulose) of a reactive polyamide/polyamine-epichlorohydrin synthetic resin (for example "Nadavin FFN" from Bayer, or "Kymene 557" from Hercules) was then added to the suspension. At the same time 1% by weight (with reference to the cellulose) of uninflated vinylidene chloride/acrylonitrile copolymer microspheres having a blowing agent of approximately 12% isobutane therein, were mixed homogeneously into the cellulose suspension and the mixture obtained was processed in a known manner into a paper sheet. In the course of the drying of the paper in the paper machine, the microspheres were inflated in situ at 80 to 110° C, and a porous, high volume raw paper was obtained.

The surfaces of the raw paper were then, while still in the paper machine, sized with a solution of 7%, by weight, of starch, and 5% by weight of $Na_2SO_4$ in water. The weight of the finished base paper was 170 g/m$^2$.

In a smoothing unit comprising a conventional calendaring machine at a line pressure of 25 kp/cm, corresponding to 245 N/cm, and at a temperature of between about 60–80° C, this paper was smoothed gently and was then, in a known manner, coated on both sides (after a previous high-frequency treatment) with polyethylene.

The polyethylene coating of the paper side later to be designated as the front side, comprises a mixture of 85%, by weight, of a pigmented polyethylene, having a density of 0.93 gm/cc, and a melt index of 4 and 15% by weight of rutile titanium dioxide. This coating weighed about 30 g/m$^2$. The polyethylene coating on the backside of the paper consisted of polyethylene having a density of 0.96 gm/cc, and a melt index of 10. That coating, likewise, weighed about 30 g/m$^2$.

The laminate thus obtained was then coated, after corona treatment of the pigmented front side, with one or several photosensitive layers on a silver halide base.

EXAMPLE 2

A photographic carrier material was prepared as described in Example 1, except that no microspheres were introduced and the weight of the base paper was about 180 g/m$^2$.

TEST RESULTS OF THE PHOTOGRAPHIC PAPERS OF EXAMPLES 1 AND 2

| | Ex. 1 | Ex. 2 |
|---|---|---|
| Weight of the raw paper (g/m$^2$) | 170 | 180 |
| Weight of polyethylene coated paper (g/m$^2$) | 230 | 240 |
| Thickness of the polyethylene coated paper (mm) | 0.235 | 0.235 |
| Microsphere content in the paper core (%) | 1 | 0 |

-continued

TEST RESULTS OF THE PHOTOGRAPHIC PAPERS OF EXAMPLES 1 AND 2

| | Ex. 1 | Ex. 2 |
|---|---|---|
| Air permeability of the raw paper, n. Gurley (sec/100 ml), (Tappi T 460 m 49) | 96–104 | 109–111 |
| Smoothness of the polyethylene coated front side (sec) (according to Tappi T 479 sm-48) | 3160 | 1630 |
| Stiffness of the polyethylene coated paper lengthwise (cm) (according to Tappi T 451 m 60) | 34.8 | 34.6 |
| Edge penetration on the polyethylene coated paper after 2 weeks storage (mm) | 0.3–0.5 | 0.8–1.2 |

The edge penetration of the photographic baths was determined after passage of the polyethylene coated material through a Hostert-Colorent Development Machine, TYP PR 12–3, using bath fluids of the Kodak Color Process CP 31.

A comparison of the test values clearly shows the advantageous effect of the thermoplastic microspheres. Most significantly, and contrary to the increased porosity and absorption that would be expected in the base paper with the introduction of microspheres, a significantly reduced edge penetration of the photographic bath fluids was observed. This is all the more surprising, because with the increase in the paper thickness and simultaneous decrease of weight of the material, an increase in the inner surface areas of the pores would be expected which would be expected to enhance capillary wetting and would increase edge penetration. On the contrary, however, edge penetration was actually reduced.

Carrier Material for Photo-Typesetting

EXAMPLE 3

A typical carrier material for photo-typesetting consists of a heavy raw paper of 70 g/m$^2$ which is coated on both sides with about 20 g/m$^2$ polyethylene.

For the production of the raw paper, a cellulose mixture was chosen of a softwood sulfate cellulose into which was mixed 34% of a hardwood sulfite cellulose. This mixture was introduced to a pulper and ground to 50° Schopper-Riegler at 4% material density. A customary color photo resin glue in the amount of 0.5% by weight (with reference to cellulose) was added to the mixture while it was still in the pulper. As soon as these ingredients were distributed sufficiently homogeneously, 0.7% by weight (with reference to cellulose) of a water soluble sodium stearate was added to the mixture. 2% by weight (with reference to the cellulose) of microspheres of the kind set forth in Example 1 were then added to and mixed homogeneously into the mixture. An aluminum sulfate solution was added to reduce the pH of the mixture to 4.5.

This mixture was then introduced to a longitudinal sieve paper machine to produce a raw paper. This raw paper was surface sized in a gluing press with a solution of 1% by weight of a synthetic glue, for example, "Scripset 520" of Monsanto Chemical Co., and 3% by weight of NaCl in water.

The raw paper thus produced was then smoothed in a conventional calendaring machine at a line pressure of 25 kp/cm, corresponding to 245 N/cm, and at a temperature of between 60°–80° C, and after a high-frequency corona treatment to inflate the microspheres, was coated on both sides with polyethylene. The front side polyethylene layer comprised a mixture of 90% by weight polyethylene, with a density of 0.93 gm/cc and a melt index of 4, and 10% by weight of rutile titanium dioxide. The backside polyethylene layer consisted of polyethylene having a density of 0.96 gm/cc and a fusion index of 10.

EXAMPLE 4

A photographic carrier material was prepared as described in Example 3, except that no microspheres were introduced.

TEST RESULTS OF THE PHOTOGRAPHIC PAPERS OF EXAMPLES 3 AND 4

| | Ex. 3 | Ex. 4 |
|---|---|---|
| Weight of the raw paper (g/m$^2$) | 65 | 65 |
| Weight of the polyethylene coated paper (g/m$^2$) | 105 | 105 |
| Thickness of the polyethylene coated paper (mm) | 0.110 | 0.108 |
| Microsphere content in the paper core (%) | 2 | 0 |
| Air permeability of the paper n. Gurley (sec/100 ml) | 112 | 153 |
| Smoothness of the polyethylene coated front side (sec) (according to Tappi T 479 sm-48) | 360 | 340 |
| Stiffness of the polyethylene coated paper lengthwide (cm) | 18.1 | 17.6 |
| Edge penetration of the polyethylene coated paper after 2 weeks storage (mm) | 1.0–1.3 | 1.9–2.8 |

The edge penetration of the photographic baths was obtained after passage of the polyethylene coated material through a Hostert Developing machine Type PR 12–3 using bath fluids of the Agfa Process 85.

Also from these tests the surprising result is clear that in spite of the increase in the paper volume and the porosity of the base paper due to the addition of the thermoplastic, hollow microspheres, the edge penetration of the photographic baths into the carrier material is significantly reduced. In addition, the smoothness and stiffness of the material are also improved as a result of the microsphere addition, although only an increase in the stiffness might have been expected given the level of prior technical knowledge.

In the present invention, previously inflated, partially inflated or non-inflated microspheres in a concentration of from 0.5 to 5.0% by weight in relation to the cellulose, and preferably in an amount of 3% by weight or less, are added to the cellulose. In addition, about 0.1 to 1% by weight water resistant or proofing media and 1 to 2% by weight retention media may be added to the cellulose microsphere mixture. Dimeric alkylketenes, known by the name "Aquapel 360XZ", have been found to be satisfactory as the water resistant medium and cationic polyamide resins, such as "Kymene 557" or "Nadavin FFN", are satisfactory as retention media.

Where non-inflated microspheres are added to the cellulose they are preferably inflated, in situ, either by the action of microwaves of high frequency e.g., at 27 MHz or by heat before the paper felt is dry. In either event, the length of time necessary for inflation will vary depending upon the type of paper and may be readily determined by a person skilled in the art. In the alternative, the previously inflated spheres may be inflated by the same means prior to addition to the cellulose.

Suitable microspheres may comprise vinylidenechloride/acrylonitrile inter polymer, with approximately 12% isobutane as a blowing agent. Such microspheres are available from the Dow Chemical Company. The diameter of spheres of this kind is on average 5μm in their non-inflated state, and their diameter can be expanded to 30 μm with thermal treatment. This thermal treatment can take place both before use and in situ.

It should be understood that the embodiments of the invention which have been described are merely illustrative of a few of the applications of the principles of the invention. Numerous modifications may be made by those skilled in the art without departing from the true spirit and scope of the invention.

What is claimed is:

1. A photographic carrier material comprising a dried cellulose sheet coated on both surfaces thereof with a polyolefin resin suitable for the deposition of at least one light sensitive liquid developable layer thereon, the improvement in said coated sheet comprising a plurality of hollow, thermoplastic microspheres substantially uniformly mixed in said cellulose sheet in an amount of about 0.5 – 5.0 weight percent based on the cellulose.

2. The carrier material of claim 1 wherein the amount of microspheres is 3.0 weight percent or less.

3. The carrier material of claim 1 including said light sensitive layer in combination therewith, said light sensitive layer comprising silver salts.

4. The carrier material of claim 1 wherein said microspheres are at least partially inflated.

5. The carrier material of claim 1 including 0.1 – 1 weight percent of a water resisting agent and 1 – 2 weight percent of a retention agent.

6. The carrier material of claim 5 wherein said water resisting agent is a dimeric alkyl composition.

7. The carrier material of claim 5 wherein said retention agent is a cationic polyamide resin.

8. The carrier material of claim 1 wherein said microspheres comprise a vinylidene chloride-acrylonitrile inter polymer.

9. The carrier material of claim 8 wherein at least some of said microspheres are filled with a blowing agent.

10. The carrier material of claim 1 wherein said polyolefin coating on at least one of the surfaces of said sheet includes a pigment mixed therein.

11. The carrier material of claim 10 wherein said pigment comprises titanium dioxide.

12. The carrier material of claim 1 wherein said microspheres are inflated prior to the coating of said surfaces with said polyolefin resin.

13. The carrier material of claim 1 wherein the surfaces of said sheet are treated, prior to the coating of said surfaces with said polyolefin resin, to improve the adhesion of said resin to said surfaces.

14. The carrier material of claim 13 wherein the surfaces of said sheet are sized, and said coating is coated on said sized surfaces.

* * * * *